US008470508B2

(12) United States Patent
Hayashi et al.

(10) Patent No.: US 8,470,508 B2
(45) Date of Patent: Jun. 25, 2013

(54) TONER MANUFACTURING METHOD

(75) Inventors: Kenji Hayashi, Tokyo (JP); Mikio Kouyama, Tokyo (JP); Hiroaki Obata, Tokyo (JP); Noriyuki Kinpara, Tokyo (JP); Yasuhiko Muramatsu, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 181 days.

(21) Appl. No.: 12/899,102

(22) Filed: Oct. 6, 2010

(65) Prior Publication Data

US 2011/0091806 A1 Apr. 21, 2011

(30) Foreign Application Priority Data

Oct. 20, 2009 (JP) ..... 2009-241007

(51) Int. Cl.
*G03G 5/00* (2006.01)

(52) U.S. Cl.
USPC ..... 430/137.15; 430/109.4

(58) Field of Classification Search
USPC ..... 430/137.15, 109.4
See application file for complete search history.

(56) References Cited

U.S. PATENT DOCUMENTS

2004/0259026 A1* 12/2004 Honma et al. ..... 430/270.1
2007/0027291 A1* 2/2007 Yano et al. ..... 528/271

FOREIGN PATENT DOCUMENTS

| | | |
|---|---|---|
| JP | 05027478 | 2/1993 |
| JP | 05-078432 | 3/1993 |
| JP | 05289401 | 11/1993 |
| JP | 2001-117268 | 4/2001 |
| JP | 2004-271686 | 9/2004 |

OTHER PUBLICATIONS

English translation of Ref. No. B19498JP01. Dispatch No. 178106, Dispatch Date: Nov. 27, 2012 Notification.
Japanese Ref. No. B19498JP01. Dispatch No. 178106, Dispatch Date: Nov. 27, 2012 Notification.

* cited by examiner

*Primary Examiner* — Mark A Chapman
(74) *Attorney, Agent, or Firm* — Lucas & Mercanti, LLP

(57) ABSTRACT

Disclosed is a toner manufacturing method, comprising: dispersing a polyester resin prepared by condensing a polyol and a polycarboxylic acid into an aqueous medium and adjusting a polyester resin particle dispersion liquid, wherein the polyol includes an unsaturated polyol, or the polycarboxylic acid includes an unsaturated polycarboxylic acid; and adding a radical polymerization initiator to the polyester resin particle dispersion liquid to cause a radical polymerization reaction, and adjusting the obtained dispersion liquid of polyester resin particles.

8 Claims, 1 Drawing Sheet

| | FOLD FIXING PERFORMANCE (%) | CHARGE QUANTITY DIFFERENCE DEPENDING ON HUMIDITY(μC/g) | IMAGE STABILITY TO HUMIDITY (−) | HOT OFFSET GENERATING TEMPERATURE (℃) | HEAT RESISTANT PRESERVABILITY | REMARKS |
|---|---|---|---|---|---|---|
| TONER 1 | 96.1 | 3.3 | ○ | 220 | 13.2 | EXAMPLE OF PRESENT INVENTION |
| TONER 2 | 95.7 | 3.6 | ○ | 215 | 14.5 | EXAMPLE OF PRESENT INVENTION |
| TONER 3 | 90.3 | 3.9 | ○ | 200 | 16.5 | EXAMPLE OF PRESENT INVENTION |
| TONER 4 | 96.1 | 6.1 | ◎ | 220 | 10.2 | EXAMPLE OF PRESENT INVENTION |
| TONER 5 | 91.7 | 1.6 | ◎ | 220 | 9.8 | EXAMPLE OF PRESENT INVENTION |
| TONER 6 | 74.9 | 3.9 | ○ | 185 | 19.2 | COMPARATIVE EXAMPLE |

| | FOLD FIXING PERFORMANCE (%) | CHARGE QUANTITY DIFFERENCE DEPENDING ON HUMIDITY( μ C/g) | IMAGE STABILITY TO HUMIDITY [–] | HOT OFFSET GENERATING TEMPERATURE (℃) | HEAT RESISTANT PRESERVABILITY | REMARKS |
|---|---|---|---|---|---|---|
| TONER 1 | 96.1 | 3.3 | ○ | 220 | 13.2 | EXAMPLE OF PRESENT INVENTION |
| TONER 2 | 95.7 | 3.6 | ○ | 215 | 14.5 | EXAMPLE OF PRESENT INVENTION |
| TONER 3 | 90.3 | 3.9 | ○ | 200 | 16.5 | EXAMPLE OF PRESENT INVENTION |
| TONER 4 | 96.1 | 6.1 | ◎ | 220 | 10.2 | EXAMPLE OF PRESENT INVENTION |
| TONER 5 | 91.7 | 1.6 | ◎ | 220 | 9.8 | EXAMPLE OF PRESENT INVENTION |
| TONER 6 | 74.9 | 3.9 | ○ | 185 | 19.2 | COMPARATIVE EXAMPLE |

TONER MANUFACTURING METHOD

CROSS-REFERENCE TO RELATED APPLICATION

The present U.S. patent application claims a priority under the Paris Convention of Japanese patent application No. 2009-241007 filed on Oct. 20, 2009, which shall be a basis of correction of an incorrect translation.

BACKGROUND OF THE INVENTION

1. Field of the Invention

The present invention relates to a toner manufacturing method.

2. Description of the Related Art

Energy saving is given as a problem of a printer or the like adopting an electrophotographic printing system, and a demand for a toner capable of being fixed at a low temperature, i.e., a toner having the so-called low temperature fixing performance, has increased.

In order to enable low temperature fixation, it has heretofore been known, as one of an effective method, to use a binding resin having a higher sharp melt performance as a toner. A polyester resin is superior as a binding resin having such a characteristic.

When a polyester resin is used as a binding resin for a toner, it is general to give an elastic modulus at a high temperature by advancing cross-linkage by using a cross-linker. Thereby hot offsets in fixation are prevented to control the toner not to have an excessive luster.

It is general to use a polycarboxylic acid of being trivalent or more as a cross-linker of the polyester resin (see, for example, Japanese Patent Application Laid-Open Publication No. H5-289401). Besides, a case of using hexamethylene tetramine or a polyvalent metal compound was disclosed (see, for example, Japanese Patent Application Laid-Open Publication No. H5-027478), but both of the disclosed materials have the problems of strong hydrophilicity at a cross-linkage point and the excessive humidity dependency of charging.

On the other hand, a technique of a hybrid resin aiming to have a heat characteristic close to that of a cross-linked resin was disclosed, which hybrid resin was produced by adding a radically polymerizable monomer, such as styrene, and a radical polymerization initiator to a polyester resin having a double bond, such as a fumaric acid unit, to make the polyester resin react with a part of a styrene resin.

However, the efficiency of the reaction of a double bond in a polyester resin and a radically polymerizable monomer, such as styrene, as described above, is low, and it is required to use a conventional polyester cross-linker in conjunction with the polyester resin practically in order to obtain an aimed elastic modulus characteristic, which fact remains as a problem.

SUMMARY OF THE INVENTION

The present invention was made in view of the aforesaid situation, and aims to provide a toner manufacturing method capable of advancing the cross-linkage of a polyester resin efficiently in a short time, securing a sufficient elastic modulus at a high temperature without using any conventional cross-linkers for polyesters, settling the problems of offsets and excessive luster, and obtaining a toner causing no toner exfoliation at a folded part, namely, having no fixation strength poverty.

To achieve at least one of the abovementioned objects, a toner manufacturing method reflecting one aspect of the present invention comprises:

dispersing a polyester resin prepared by condensing a polyol and a polycarboxylic acid into an aqueous medium and adjusting a polyester resin particle dispersion liquid, wherein the polyol includes an unsaturated polyol, or the polycarboxylic acid includes an unsaturated polycarboxylic acid; and adding a radical polymerization initiator to the polyester resin particle dispersion liquid to cause a radical polymerization reaction, and adjusting the obtained dispersion liquid of polyester resin particles.

BRIEF DESCRIPTION OF THE DRAWINGS

The present invention will become more fully understood from the detailed description given hereinbelow and the appended drawings, and thus are not intended as a definition of the limits of the present invention, wherein;

The FIGURE contains Table 1.

DETAILED DESCRIPTION OF THE PREFERRED EMBODIMENTS

In the following, a toner manufacturing method according to the present invention will be described.

The toner manufacturing method according to the present invention comprises:

dispersing a polyester resin prepared by condensing a polyol and a polycarboxylic acid into an aqueous medium and adjusting a polyester resin particle dispersion liquid, wherein the polyol includes an unsaturated polyol, or the polycarboxylic acid includes an unsaturated polycarboxylic acid; adding a radical polymerization initiator to the polyester resin particle dispersion liquid to cause a radical polymerization reaction, and adjusting the dispersion liquid of the obtained polymer and polyester resin particles; mixing the dispersion liquid of the polyester resin particles including the polymer and the polyester resin, and a dispersion liquid of coloring agent particles; and agglutinating the polyester resin particles and the coloring agent particles to form toner particles.

A mold parting agent, an externally added agent, and the like are used, as the occasion demands, besides a binding resin and a coloring agent, for manufacturing a toner.

<Binding Resins>

As the binding resins, polyester resins are used. The polyester resins to be used for the manufacturing method of the present invention are publicly known bivalent or more alcohol components and publicly known bivalent or more carboxylic acid components.

As the alcohol components, for example, a trivalent or more polyol, such as glycerin, pentaerythritol, trimethylolpropane, and sorbitol, are given besides aliphatic diols, such as 1,2-propanediol, 1,3-propanediol, 1,4-butanediol, 1,5-pentanedial, 1,6-hexanediol, 1,7-Heptanediol, 1,8-octanediol, neopentyl glycol, and 1,4-butenediol, and aromatic diols, such as an alkylene oxide adduct of bisphenol A. Two kinds or more of these alcohol components may be combined with each other to be used.

As the bivalent or more alcohol components, an unsaturated alcohol may be preferably used in advancing the reaction according to the present invention.

As the unsaturated alcohol, alkene dial may be used, and more specifically, 2-butyne-1,4 diol, 3-butyne-1,4 diol, or 9-octadecene-7,12 diol may for example be used to obtain the effects of the present invention.

As the polycarboxylic acid components, a fumaric acid, a maleic acid, and an itaconic acid are preferably used in advancing the reaction according to the present invention.

As the polycarboxylic acid components that may be used in conjunction, a carboxylic acid, a carboxylic acid anhydride, a carboxylic acid ester, and the like are used, and a benzenedicarboxylic acid and a saturated carboxylic acid are preferably used as the carboxylic acid components. For example, saturated aliphatic dicarboxylic acids, such as an oxalic acid, a malonic acid, a succinic acid, an adipic acid, a sebacic acid, an azelaic acid, and an n-dodecyl succinic acid; alicyclic dicarboxylic acids, such as a cyclohexanedicarboxylic acid; and aromatic dicarboxylic acids, such as a phthalic acid, an isophthalic acid, and a terephthalic acid may be used individually, or may be used in combination with other one or more of them.

Furthermore, hybridization may be accelerated by using an unsaturated hydroxy carboxylic acid monomer, such as a caffeic acid, as a monomer for polyesters.

A polyester resin can be manufactured by, for example, performing the condensation polymerization of one of the alcohol components mentioned above and one of the carboxylic acid components mentioned above in an inert gas atmosphere at a temperature within a range of from 120° C. to 250° C. At the time of performing the condensation polymerization, a publicly known esterification catalyst may be used as the occasion demands.

<Coloring Agents>

As the coloring agents, publicly known coloring agents, such as a carbon black, a magnetic substance, a dye, and a pigment, can arbitrarily be used.

As black coloring agents, magnetic powders of magnetite, ferrite, and the like can be used besides carbon blacks, such as a furnace black and a channel black.

As the coloring agents of the other colors, pigments, such as C.I. pigment red 5, 48:1 of the same, 53:1 of the same, 57:1 of the same, 81:4 of the same, 122 of the same, 139 of the same, 144 of the same, 149 of the same, 166 of the same, 177 of the same, 178 of the same, 222 of the same, C.I. pigment yellow 14, 17 of the same, 74 of the same, 93 of the same, 94 of the same, 138 of the same, 155 of the same, 180 of the same, 185 of the same, C.I. pigment orange 31, 43 of the same, C.I. pigment blue 15:3, 60 of the same, and 76 of the same can be given. Furthermore, dyes, such as C.I. solvent red 1, 49 of the same, 52 of the same, 58 of the same, 68 of the same, 11 of the same, 122 of the same, C.I. solvent yellow 19, 44 of the same, 77 of the same, 79 of the same, 81 of the same, 82 of the same, 93 of the same, 98 of the same, 103 of the same, 104 of the same, 112 of the same, 162 of the same, C.I. solvent blue 25, 36 of the same, 69 of the same, 70 of the same, 93 of the same, and 95 of the same can be given. Furthermore, these pigments and dyes may be mixed with one another. As the mixtures, metal salts of acids, benzilic acid metallic complexes, or the like can be given.

As the externally added agents, a publicly known hydrophobic silica and a hydrophobic metal oxide can be given, and it is preferable from the point of view of a filming resistance property to add cerium oxide particles, titanate particles, a fatty acid having a carbon number within a range from 20 to 50, or higher alcohol particles to use the latter materials in conjunction with the former materials. In case of adding the cerium oxide particles or the titanate particles, it is preferable to use the particles of a number average particle diameter within a range of from 150 nm to 800 nm from the point of view of enhancing the filming resistance property.

<Toner Manufacturing Method>

In the following, concrete examples of the manufacturing method of the present invention are given.

(1) Process of Dispersing a Polyester Resin Produced by Condensing a Polyol and a Polycarboxylic Acid in an Aqueous Medium to Adjust the Polyester Resin Particle Dispersion Liquid After dissolving a polyester resin into a solvent, such as ethyl acetate, and performing the emulsification dispersion of the polyester resin into an aqueous medium with a disperser, desolvation processing may be performed. Alternatively, the polyester resin may be dispersed at a temperature of 120° C. or more without using any solvents. Alternatively, as disclosed in Japanese Patent Application Laid-Open Publication No. 2006-337995, a polyester resin particle dispersion liquid may be produced by condensing droplets of a polyol and a polycarboxylic acid after the droplets have been formed in an aqueous medium together with a strong acid, such as a dodecyl benzenesulfonic acid. Each of the polyester resin particles preferably has 50-400 nm as volumetric basis median diameter. If there is room for production facilities, toner internal additives such as a mold parting agent, a coloring agent, and charge controlling agent, may be included and dispersed to the polyester resin (solution) in advance, when making the polyester resin particle dispersion liquid.

Here, the aqueous medium is referred to as water including a dispersion agent such as a surface active agent, and the like, however, the aqueous medium may also be water in which an organic solvent such as alcohol, ketones, and the like, is dissolved therein by less than 50%.

In addition, in the polyester resin, it is supposed either the polyol includes unsaturated polyol, or the polycarboxylic acid includes unsaturated polycarboxylic acid. Fumaric acid and itaconic acid, both of which are unsaturated polycarboxylic acids, are preferable because of the high radical polymerization property thereof.

(2) Process of Adjusting the Dispersion Liquid Including a Polymer obtained by Adding a Radical Polymerization Initiator to the Polyester Resin Particle Dispersion Liquid to Perform the Radical Polymerization Reaction, and also Including the Polyester Resin A polymerization initiator is added to the polyester resin particle dispersion liquid of the aforesaid item (1), and a dispersion liquid of resin particles produced by the radical polymerization reaction is prepared. At this time, a chain transfer agent may be added in order to adjust the molecular weight of the polymer.

As the polymerization initiators, water soluble polymerization initiator is especially preferable. For example, water soluble radical polymerization initiators, such as persulfates of potassium persulfate, ammonium persulfate, and the like, are preferably used in order to obtain the effects of the present invention. At the time of adjusting the polyester resin particle dispersion liquid, when a process in which the polyester resin is dissolved into an organic solvent is provided, an oil soluble initiator such as an alkyl peroxide may be added.

The aforementioned items (1) and (2) are essential processes in the toner manufacturing method according to the present invention. At this stage, the polyester resin particles in the polyester resin particle dispersion liquid may be subjected to a solid-liquid separation, and the polyester resin may be dried to manufacture toners by a publically known kneading/pulverization method. However, in order to obtain small diameter toners in which the particle size distribution is sharp, it is preferable that the processes of (3) to (7) are provided which are described in the followings.

Hereinbelow, the processes of (3) to (7) may be performed according to the generally performed and publically known procedures.

(3) Process of Obtaining a Dispersion Liquid of Coloring Agent Particles Obtained by Dispersing a Coloring Agent into an Aqueous Medium Oil droplet dispersion is performed by means of mechanical energy, and the disperser thereof is not particularly limited. Clearmix (manufactured by M Technique Co, Ltd.), which is an agitator equipped with a rotor capable of high speed rotation, an ultrasonic disperser, a mechanical homogenizer, Cavitron, Manton Galin, pressure type homogenizer, and the like can be used.

Each of the coloring agent particles in a dispersion liquid adjusted in this process preferably has a volumetric basis median diameter within a range of from 10 nm to 300 nm, and more preferably within a range of from 100 nm to 200 nm, and furthermore preferably within a range of from 100 nm to 150 nm. For example, by adjusting the magnitude of the aforesaid mechanical energy, the volumetric basis median diameter can be controlled within the aforesaid ranges.

(4) Process of Performing the Cohesion and the Fusion of Resin Particles and the Coloring Agent Particles to Form Toner Particles by Adding a Coagulant to an Aqueous Medium in Which the Dispersion Liquid of the Resin Particles and the Dispersion Liquid of the Coloring Agent Particles Are Mixed, and by Adjusting the Temperature of the Aqueous Medium As the coagulants, for example, alkali metal salts and alkaline earth metal salts are given. As the alkaline metals of these salts, lithium, potassium, sodium, and the like are given. Furthermore, as the alkaline earth metals of these salts, magnesium, calcium, strontium, barium, and the like are given. Among them, potassium, sodium, magnesium, calcium, and barium are particularly preferable. As the counterions (anions constituting the salts) of the alkaline metals or the alkaline earth metals, chloride ions, bromide ions, iodide ions, carbonate ions, sulfate ion, and the like are given. As the coagulants, water soluble organic solvents, such as alcohol, tetrahydrofuran, and ketone, may also be used. In a case where a process to dissolve the organic solvent into the polyester resin is provided, at the time of adjusting the polyester resin particle dispersion liquid, the additive amount of the coagulants may be of extremely small quantity or even may be omitted, by making approximately 5-20% of organic solvent remained in the polyester resin particles. However, in such a case, a process to remove the solvent after the toner particles have been agglutinated to the desired particle diameter is to be required.

In case of adding a mold parting agent, it is only necessary to add the dispersion liquid (wax emulsion) of the mold parting agent particles into the aforesaid aqueous medium in this process, and to perform the salting-out and the cohesion of the resin particles, the coloring agent particles, and the mold parting agent particles. Alternatively, it may be performed to add the dispersion liquid of the mold parting agent particles to prepare a dispersion liquid of the resin particles and the mold parting agent particles in advance in the process of the aforementioned item (1) or (2), and then to perform the cohesion at the process of the item (4).

(5) Process of Filtering out Toner Particles from the Aqueous Medium and Removing Undesired Substances, such as a Surface Active Agent from the Toner Particles by Washing Processing (6) Process of Performing the Drying Processing of the Toner Particles Subjected to the Washing Processing (7) Process of Adding an Externally Added Agent to the Toner Particles Subjected to the Drying Processing When the occasion demands, the externally added agent such as a hydrophobic silica or metal oxide particles, and the toner particles obtained by the process of item (6) may be subjected to dry blending.

Examples

In the following, concrete examples of the present invention will be described, but the present invention is not limited to those examples.

1. Making Noncrystalline Polyester Resins (A-1) to (A-6)

<Making Noncrystalline Polyester Resin (A-1)>

(Polycarboxylic Acid Monomer)

fumaric acid: 2.1 parts by mass terephthalic acid: 36 parts by mass isophthalic acid: 5.2 parts by mass 5-sulfoisophthalic acid: 0.66 parts by mass (Polyol Monomer)

adduct of 2 moles of propylene oxide to 2,2-bis (4-hydroxyphenyl) propane: 76 parts by mass, molecular weight=460 adduct of 2 moles of ethylene oxide to 2,2-bis(4-hydroxyphenyl)

propane: 24 parts by mass, molecular weight=404

The polycarboxylic acid monomer and the polyol component were stocked in a reaction container equipped with an agitator, a nitrogen introducing pipe, a temperature sensor, and a rectifying column, and one hour was spent to raise the temperatures of the polycarboxylic acid monomer and the polyol component to 190° C. After ascertaining that the inside of the reaction system was agitated to be uniform, a catalyst $Ti(OBu)_4$ was projected (0.003 percents by mass of the whole polycarboxylic acid monomer).

Furthermore, it was needed for six hours to raise the temperature to 240° C. from the aforesaid temperature while distilling away produced water, and the dehydration condensation reaction was continued for further six hours at 240° C. to perform polymerization. Thereby, a noncrystalline polyester resin (A-1) was obtained. By the measurement of the molecular weight of the resin of the obtained noncrystalline polyester resin (A-1) with a gel permeation chromatography (GPC) (HLC-8 120 GPC manufactured by Tosoh Corporation), it was found that the number average molecular weight was 3100 (converted by the styrene reference material). Furthermore, as the result of the measurement of the heat characteristic of the obtained resin with a differential scanning calorimeter (DSC) (Diamond DSC manufactured by PerkinElmer, Inc.) (the speed of temperature rise: 10° C./min), it was found that the glass transition temperature (Tg) thereof was 63° C.

<Making Noncrystalline Polyester Resin (A-2)>

A noncrystalline polyester resin (A-2) was made by a similar method to that of the noncrystalline polyester resin (A-1) except that the part of the polycarboxylic acid monomer was changed to the followings. The number average molecular weight was 2900, and the Tg was 66° C.

(Polycarboxylic Acid Monomer)

itaconic acid: 2.4 parts by mass terephthalic acid: 36 parts by mass isophthalic acid: 5.2 parts by mass 5-sulfoisophthalic acid: 0.66 parts by mass <Making Noncrystalline Polyester Resin (A-3)>

A noncrystalline polyester resin (A-3) was made by a similar method to that of the noncrystalline polyester resin (A-1) except that the parts of the polycarboxylic acid monomer and the polyol monomer were changed to the followings. The number average molecular weight was 3200, and the Tg was 65° C.

(Polycarboxylic Acid Monomer)

terephthalic acid: 37 parts by mass isophthalic acid: 6 parts by mass 5-sulfoisophthalic acid: 0.64 parts by mass (Polyol Monomer)

adduct of 2 moles of propylene oxide to 2,2-bis (4-hydroxyphenyl) propane: 71 parts by mass adduct of 2 moles of ethylene oxide to 2,2-bis(4-hydroxyphenyl) propane: 19 parts by mass 2-butyne-1,4-diol (unsaturated polyol): 71 parts by mass <Making Noncrystalline Polyester Resin (A-4)>

A noncrystalline polyester resin (A-4) was made by a similar method to that of the noncrystalline polyester resin (A-1) except that the part of the polycarboxylic acid monomer was changed to the followings. The number average molecular weight was 3500, and the Tg was 61° C.

(Polycarboxylic Acid Monomer)

maleic acid: 9.8 parts by mass terephthalic acid: 36 parts by mass

<Making Noncrystalline Polyester Resin (A-5)>

A noncrystalline polyester resin (A-5) was made by a similar method to that of the noncrystalline polyester resin (A-1) except that the part of the polycarboxylic acid monomer was changed to the followings. The number average molecular weight was 4400, and the Tg was 59° C.

(Polycarboxylic Acid Monomer)

itaconic acid: 5.8 parts by mass terephthalic acid: 36 parts by mass isophthalic acid: 5.2 parts by mass <Making Noncrystalline Polyester Resin (A-6) for Comparison>

A noncrystalline polyester resin (A-6) was made by a similar method to that of the noncrystalline polyester resin (A-1) except that the part of the polycarboxylic acid monomer was changed to the followings, and that both of unsaturated polycarboxylic acid and unsaturated polyol were not used. The number average molecular weight was 3500, and the Tg was 54° C.

(Polycarboxylic Acid Monomer)

succinic acid: 1.0 parts by mass terephthalic acid: 36 parts by mass

2. Preparation of Dispersion Liquids of the Noncrystalline Polyester Resins (A-1) to (A-6)

<Preparation of a Dispersion Liquid of the Noncrystalline Polyester Resin (A-1)>

The obtained noncrystalline polyester resin (A-1) was transferred to Cavitron CD1010 (manufactured by Eurotec, Ltd.) at a speed of 100 parts by mass per minute in its molten state. Dilute aqueous ammonia of the concentration of 0.37 percents by mass prepared by diluting regent aqueous ammonia with an ion-exchange water was put into a separately prepared aqueous medium tank, and the dilute aqueous ammonia was transferred to Cavitron CD100 (manufactured by Eurotec, Ltd.) at the speed of 0.1 liter per minute while being heated to 160° C. with a heat exchanger at the same time as the transfer of the noncrystalline polyester resin (A-1) in its molten state. Cavitron CD1010 was driven under the conditions that the rotation speed of the rotor thereof was 60 Hz and the pressure thereof was 5 kg/cm$^2$, and the noncrystalline polyester resin (A-1) dispersion liquid having a volumetric basis median diameter of 218 nm and 30 parts by mass of solid content quantity was obtained.

<Preparation of a Dispersion Liquid of the Noncrystalline Polyester Resin (A-2)>

As for also the noncrystalline polyester resin (A-2), a noncrystalline polyester resin (A-2) dispersion liquid was obtained by a similar method to that of the <Preparation of a Dispersion Liquid of the Noncrystalline Polyester Resin (A-1)>. The volumetric basis median diameter thereof was 176 nm.

<Preparation of a Dispersion Liquid of the Noncrystalline Polyester Resin (A-3)>

As for also the noncrystalline polyester resin (A-3), a noncrystalline polyester resin (A-3) dispersion liquid was obtained by a similar method to that of the <Preparation of a Dispersion Liquid of the Noncrystalline Polyester Resin (A-1)>. The volumetric basis median diameter thereof was 235 nm.

<Preparation of a Dispersion Liquid of the Noncrystalline Polyester Resin (A-4)>

As for also the noncrystalline polyester resin (A-4), a noncrystalline polyester resin (A-4) dispersion liquid was obtained by a similar method to that of the <Preparation of a Dispersion Liquid of the Noncrystalline Polyester Resin (A-1)>. The volumetric basis median diameter thereof was 240 nm.

<Preparation of a Dispersion Liquid of the Noncrystalline Polyester Resin (A-5)>

As for also the noncrystalline polyester resin (A-5), a noncrystalline polyester resin (A-5) dispersion liquid was obtained by a similar method to that of the <Preparation of a Dispersion Liquid of the Noncrystalline Polyester Resin (A-1)>. The volumetric basis median diameter thereof was 190 nm.

<Preparation of a Dispersion Liquid of the Noncrystalline Polyester Resin (A-6) for Comparison>

As for also the noncrystalline polyester resin (A-6) for comparison, a noncrystalline polyester resin (A-6) dispersion liquid for comparison was obtained by a similar method to that of the <Preparation of a Dispersion Liquid of the Noncrystalline Polyester Resin (A-1)>. The volumetric basis median diameter thereof was 210 nm.

3. Adjustment of Mold Parting Agent Dispersion Liquid

<Preparation of a Mold Parting Agent Dispersion Liquid 1> tribehenate citrate wax (melting point: 83.2° C.): 60 parts ionizable surface active agent (Neogen RK manufactured by Dai-Ichi Kogyo Seiyaku Co., Ltd.): 5 parts ion-exchange water: 240 parts A solution containing the mixed aforesaid components was heated to 95° C., and the solution was sufficiently dispersed with ULTRA-TURRAX T50 manufactured by IKA Company. After that, the dispersed solution was subjected to dispersion processing with a pressure discharging type Colin homogenizer to obtain the mold parting agent dispersion liquid 1 having a volume mean diameter of 240 nm and a solid content quantity of 20 percents by mass.

4. Preparing Polyester Resin Particle Dispersion Liquids 1-6 Subjected to Radical Polymerization Reaction <Preparing the Polyester Resin Particle Dispersion Liquid 1 Subjected to Radical Polymerization Reaction>

A polymerization initiator solution obtained by dissolving 10.3 parts by mass of potassium persulfate into 210 parts by mass of ion-exchange water was added to 1450 parts by weight of "noncrystalline polyester resin (A-1) dispersion liquid," obtained by the aforesaid method, 650 parts by weight of "mold parting agent dispersion liquid 1," and 1250 parts by weight of ion-exchange water, and were heated and mixed for two hours to perform polymerization under the temperature condition of 80° C. After the polymerization, the above mixture was cooled down to 28° C., thereby "the polyester resin particle dispersion liquid 1 subjected to radical polymerization reaction" was made. "The polyester resin particle dispersion liquid 1 subjected to radical polymerization reaction" was then subjected to a solid-liquid separation, and the weight-average molecular weight of the polyester resin particle dispersion liquid 1 subjected to radical polymerization reaction was specified to be 28700. Incidentally, the tetrahydrofuran insoluble part, that is to say the gel part, was 6.4% with respect to (the solid part of) the polyester resin particle dispersion liquid 1 subjected to radical polymerization reaction. The gel part was analyzed by Solid C13NMR, and was confirmed that the peak of third-class carbon was raised in comparison to that of the solid part of noncrystalline polyester resin (A-1) dispersion liquid, although it was difficult to perform a quantitative comparison.

<Preparing the Polyester Resin Particle Dispersion Liquids 2 and 3 Subjected to Radical Polymerization Reaction>

The polyester resin particle dispersion liquids 2 and 3 subjected to the radical polymerization reaction were made by similar methods to that of the polyester resin particle dispersion liquid 1 subjected to the radical polymerization reaction except that the "noncrystalline polyester resin (A-1) dispersion liquid" in the preparation of the polyester resin particle dispersion liquid 1 subjected to the radical polymerization reaction was changed to the "noncrystalline polyester resin (A-2) dispersion liquid" and the "noncrystalline polyester resin (A-3) dispersion liquid," respectively. The molecular weights of the polyester resin particle dispersion liquids 2 and 3 subjected to the radical polymerization reaction were 26300 and 27900, respectively. The gel parts thereof were 5.8% and 4.2%, respectively. Further, the gel parts were analyzed by Solid C13NMR, and were confirmed that the peak of third-class carbon was raised in comparison to that of the polyester resin before the radical polymerization initiator was added.

<Preparing the Polyester Resin Particle Dispersion Liquids 4 and 5 Subjected to Radical Polymerization Reaction>

The polyester resin particle dispersion liquids 4 and 5 subjected to the radical polymerization reaction were made by similar methods to that of the polyester resin particle dispersion liquid 1 subjected to the radical polymerization reaction except that the "noncrystalline polyester resin (A-1) dispersion liquid" in the preparation of the polyester resin particle dispersion liquid 1 subjected to the radical polymerization reaction was changed to the "noncrystalline polyester resin (A-4) dispersion liquid" and the "noncrystalline polyester resin (A-5) dispersion liquid," respectively. The molecular weights of the polyester resin particle dispersion liquids 4 and 5 subjected to the radical polymerization reaction were 24400 and 26700, respectively. The gel parts thereof were 4.5% and 6.0%, respectively. Further, the gel parts were analyzed by Solid C13NMR, and were confirmed that the peak of third-class carbon was raised in comparison to that of the polyester resin before the radical polymerization initiator was added.

<Preparing the Polyester Resin Particle Dispersion Liquid 6 for Comparison>

The polyester resin particle dispersion liquid 6 for comparison subjected to the radical polymerization reaction was made by similar methods to that of the polyester resin particle dispersion liquid 1 subjected to the radical polymerization reaction except that the "noncrystalline polyester resin (A-1) dispersion liquid" in the preparation of the polyester resin particle dispersion liquid 1 subjected to the radical polymerization reaction was changed to the "noncrystalline polyester resin (A-6) dispersion liquid". The molecular weight of the polyester resin particle dispersion liquid 6 for comparison subjected to the radical polymerization reaction was 16400, and the gel part thereof did not exist. Further, the gel part was analyzed by Solid C13NMR, and was confirmed that the peak of third-class carbon was not detected in comparison to that of the polyester resin before the radical polymerization initiator was added.

Incidentally, the dispersion particle diameter of the polyester resin particle liquids 4-5, and polyester resin particle dispersion liquid 6 for comparison, each of which were subjected to the radical polymerization reaction, respectively, did not vary from that of the noncrystalline polyester resin (A-1)-(A-6) dispersion liquids.

5. Making Coloring Agent Fine Particle Dispersion Liquid

<Making Coloring Agent Fine Particle Dispersion Liquid 1>

11.5 parts by mass of n-sodium dodecyl sulfate was agitated and dissolved into 160 parts by mass of ion-exchange water, and 25 parts by mass of C.I. pigment blue 15:3 was gradually added thereto. Next, the C.I. pigment blue 15:3 was dispersed with "Clearmix W-Motion CLM-0.8" (manufactured by M Technique Co., Ltd.) to obtain the coloring agent fine particle dispersion liquid 1 containing coloring agent fine particles 1 having a volumetric basis median diameter of 158 nm.

In addition, the volumetric basis median diameter was measured under the following measurement conditions with "MICROTRAC UPA 150" (manufactured by Honeywell International Inc.).

[Measurement Conditions]

sample refraction index: 1.59 sample specific gravity: 1.05 (converted by the sphere-shaped particle)

solvent refraction index: 1.33 solvent viscosity: 0.797 at 30° C. and 1.002 at 20° C.

The ion-exchange water was put into a measurement cell, and the zero point adjustment thereof was performed.

6. Manufacturing Toners 1-6

<Manufacturing a Toner 1>

400 parts by mass (converted by the solid content) of "polyester resin particle dispersion liquid 1 subjected to the radical polymerization reaction," as a core resin, 1500 parts by mass of ion-exchange water, and 165 parts by mass of "coloring agent particle dispersion liquid 1" were projected into a separable flask equipped with a thermometer, a cooling pipe, a nitrogen introducing device, and an agitator. Furthermore, aqueous sodium hydroxide (25 percents by mass) was added in the state of keeping the temperature in the system at 30° C. to adjust the hydrogen ion exponent (pH) thereof to be 10.

Next, an aqueous solution in which 54.3 parts by mass of magnesium chloride Ω6 hydrate was dissolved in 54.3 parts by mass of an ion-exchange water was added, and after that, the temperature in the system was raised to 60° C. to start the agglutination reactions of the polyester resin particles subjected to the radical polymerization reaction and the coloring agent particles.

Agitation was continued until the volumetric basis median diameter ($D_{50}$) of the particles became 6 μm. The agitation was further continued for one hour with the temperature kept at 60° C., and then 20.1 parts by mass of iminocarboxylic acid compound (9-2) was added.

When the degrees of circularity of toner particles were measured with a flow type particle image analyzing device "FPIA-2100" (manufactured by Sysmex Corporation), it was found that the degree of circularity of the toner particles at this time point was 0.951. The agitation was continued for four hours with the temperature kept at 85° C., and the toner particle dispersion liquid was cooled to 30° C. under the condition of 6° C. per minute when the degree of circularity of the toner particles reached 0.976 to complete the reactions.

Next, the solid-liquid separation of the produced toner particle dispersion liquid was performed with a basket type centrifugal separator "MARK III type" (model number 60×40) (manufactured by Matsumoto Kikai MFG. Co., Ltd.) to form a wet cake of the toner. After that, the washing and the solid-liquid separation of the toner were repeated until the value of the electric conductivity of the filtrate became 15 μS/cm or less.

Next, the wet cake was moved to an airflow type dryer "Flash Jet Dryer" (manufactured by Seishin Enterprise Co., Ltd.), and the drying processing of the wet cake was performed until the water quantity thereof became 0.5 percents by mass. In addition, the drying processing was performed by blowing an airflow of 40° C. and 20% RH against the water cake. The dried toner was slowly cooled to 24° C., and 1.0 part by mass of hydrophobic silica was mixed to 100 parts by mass of toner with a Henschel mixer. After setting the peripheral speed of the rotor blade to 24 m/s and mixing the mixture for 20 minutes, the mixture was made to pass through a sieve of 400 meshes. The thus obtained toner is referred to the "toner 1."

<Manufacturing the Toners 2-6>

As described in Table 1 which is shown in FIG. 1, the toners 2-6 were made by similar methods to that of the toner 1 except that the "polyester resin particle dispersion liquid 1 subjected to the radical polymerization reaction" in the manufacturing of the toner 1 was changed to "polyester resin particle dispersion liquids 2-5 subjected to the radical polymerization reaction", and "polyester resin particle dispersion liquid 6 for comparison", respectively.

7. Preparing Developing Agents

Ferrite carriers coated by a silicone resin and having a volume average diameter of 60 nm were mixed to each of the made toners 1-6 to prepare the developing agent of each of the toners 1-6. The developing agent was mixed to each toner so that the concentration of the toner in each developing agent became 6 percents by mass.

8. Evaluation Experiments

The developing agent of each of the toners 1-6 was mounted on a commercially available multifunction peripheral (manufactured by Konica Minolta Business Technologies, Inc.). Then, evaluation tests of the following respective items were performed, and the results are described in Table 1.

<Fold Fixing Performance>

As for fold fixing performances (strength), the fixation ratios of toner images at folds of sheets of paper at the time of setting the surface temperature of the heating roller to 170° C. were evaluated. To put it concretely, when a fixation image of a toner was bent toward the inner surface of the image, the degree of the exfoliation of the toner at the bent part was evaluated as a fixation ratio.

The measurement method was performed as follows: folding a solid image part (image concentration: 0.8) so that the image surface became inside, rubbing the folded part with a finger three times, then opening the image to wipe the image three times with "JK wiper (manufactured by Nippon Paper Crecia Co., Ltd.)", and calculating the value of the fixation ratio on the basis of the image concentrations at the folding position of the image before and after the folding in conformity with the following formula.

Fixation Ratio(%)=(image concentration after folding)/(image concentration before folding)×100

The fold fixation strength was evaluated from the obtained fixation ratios as follows, and the fold fixation strength of 80% or more was evaluated to be acceptant.

Evaluation Criterion

Excellent: the fixation ratio at a fold at each temperature was 90% to 100%

Good: the fixation ratio at a fold at each temperature was 80% or more and less than 90%

Rejected: the fixation ratio at a fold was less than 80%

<Charge Quantity Difference Depending on Humidity>

19 g of a carrier and 1 g of a toner were put in a container made of a glass and having a capacity of 20 ml, and the container was shaken for 20 minutes in the following two environments (low temperature and low humidity environment, and high temperature and high humidity environment) under the conditions of: the shaking frequency of 200 times per minute, the shaking angle of 45 degrees, the arm length of 50 cm. After that, the charge quantities were measured by a blowoff method.

Low Temperature and Low Humidity Environment: setting of 10° C. and 10% RH atmosphere High Temperature and High Humidity Environment: setting of 30° C. and 85% RH atmosphere The ranks of the toners 1-6 were evaluated on the basis of the differences between the charge quantities in the low temperature and low humidity environments and the charge quantities in the high temperature and high humidity environments.

Excellent: less than 2 μC/g (excellent)

Good: 2 μC/g or more and less than 8 μC/g (good)

Practicable: 8 μC/g or more and less than 12 μC/g (practicable)

Rejected: 12 μC/g or more (nonpracticable)<

<Image Stability to Humidity>

After 100,000 sheets of continuous running of an image having a C/W ratio of 20% were performed in the L/L environment (10° C., 15% RH) and the H/H environment (30° C., 85% RH), the fogging on the white ground parts of the image and the fogging on a photosensitive body were visually observed. As the sheets of transfer paper, sheets of glossy paper, each having brightness of 92 and a thickness of 80 g/m$^2$, were used.

Good "◎": no falls of image concentration and no fogging were generated

Practicable "o": some falls of image concentration and/or some pieces of fogging could be ascertained with a loupe of 20 times, but their levels were ones practically causing no problems.

Rejected "x": falls of image concentration and fogging were generated and their levels were ones practically causing problems.

<Hot Offset Generating Temperature>

The evaluation machine was remodeled to be able to change the temperature of its fixation roller by the 5° C., and hot offset generating temperatures were examined. Sheets of glossy paper, each having a thickness of 80 g/m$^2$, were used. If no hot offsets were produced at 210° C., the toner was judged to be acceptable.

<Heat Resistant Preservability>

First, 0.5 g of the toner was extracted in a glass bottle of 10 ml, which glass bottle has an inner diameter of 21 mm, and the cap thereof was closed to be shaken by 600 times with a tap denser "KYT-2000 (made by Seishin Enterprise Co., Ltd.). After that, the cap was taken off, and the glass bottle was left as it was in an environment of a temperature of 55° C. and humidity of 35% RH for 2 hours. Next, the toner was placed on a sieve of 48 meshes (aperture 350 μm) so as not to be shredded, and was set in "Powder Tester" (made by Hosokawa Micron Corporation) to be fixed with a pressure bar and a knob nut. The toner was vibrated for 10 seconds after adjusting "Powder Tester" to the vibration strength of a feed width of 1 mm. After that, the toner quantity remaining on the sieve was measured, and the ratio of the remaining toner was calculated (% by mass).

The toner agglutination rate was calculated by the following formula:

$$\text{Toner Agglutination Rate}(\%)=[(\text{toner mass remaining on the sieve (g)})/0.5\ (\text{g})]\times 100.$$

The evaluations of the heat resistant preservability were performed on the basis of the following criteria:

◎: The toner agglutination rate was less than 15% by mass (the heat resistant preservability was extremely good).

o: The toner agglutination rate was 20% by mass or less (heat resistant preservability was good).

x: The toner agglutination rate exceeded 20% by mass (the heat resistant preservability of the toner was bad and could not be used)

From the results described above, the examples of the present invention could be judged to be superior to the comparative example in any of the fold fixing performances, the charge quantity differences depending on humidity, the image stability to humidity, hot offset generating temperatures and heat resistant preservability.

According to a preferred embodiment of the present invention, there is provided a toner manufacturing method, comprising:

dispersing a polyester resin prepared by condensing a polyol and a polycarboxylic acid into an aqueous medium and adjusting a polyester resin particle dispersion liquid, wherein the polyol includes an unsaturated polyol, or the polycarboxylic acid includes an unsaturated polycarboxylic acid; and adding a radical polymerization initiator to the polyester resin particle dispersion liquid to cause a radical polymerization reaction, and adjusting the obtained dispersion liquid of polyester resin particles.

Preferably, the toner manufacturing method further comprises mixing the dispersion liquid of the polyester resin particles and a dispersion liquid of coloring agent particles; and agglutinating the polyester resin particles and the coloring agent particles to form toner particles.

Preferably, the polyester resin includes an unsaturated polycarboxylic acid.

Preferably, the unsaturated polycarboxylic acid is a fumaric acid.

Preferably, the radical polymerization initiator is a water soluble radical polymerization initiator.

Preferably, the water soluble radical polymerization initiator is potassium persulfate.

Preferably, a volumetric basis median diameter of each of the polyester resin particles is within a range of 50 to 400 nm.

Preferably, a volumetric basis median diameter of each of the coloring agent particles is within a range of 10 to 300 nm.

According to the present invention, the cross-linkage reaction efficiency advances in a short time. In addition, the elastic modulus improves at the time of fusion. Even if no conventional cross-linkers for polyesters are used, it is possible to secure a sufficient elastic modulus at a high temperature, and to settle the problems of offsets and excessive luster. Furthermore, it is possible to obtain a toner causing no toner exfoliation at a folded part, namely, having no fixation strength poverty.

The mechanism of the present invention can be guessed as follows here.

The present invention is provided with a process of dispersing a polyester resin, produced by condensing polyol and polycarboxylic acid, into an aqueous medium, and adjusting the polyester resin particle dispersion liquid. In this process, the specific surface area of the polyester resin expands.

When a radical polymerization initiator is added to the polyester resin particle dispersion liquid, the radical polymerization initiator can comparatively freely move in the aqueous medium, and consequently the frequency (probability) of radical's attacks on the surface of the polyester resin particles rises.

Furthermore, it becomes unnecessary to add any cross-linkers for accelerating hydration to the polyester resin itself. Consequently, the humidity dependency of charging reduces, and the variations of development and transfer characteristics caused by the variations of humidity are improved to stabilize images and image qualities.

Although various exemplary embodiments have been shown and described, the invention is not limited to the embodiments shown. Therefore, the scope of the invention is intended to be limited solely by the scope of the claims that follow.

What is claimed is:

1. A toner manufacturing method, comprising:

a) condensing a polyol and a polycarboxylic acid to form a polyester resin, wherein the polyol includes an unsaturated polyol or the polycarboxylic acid includes an unsaturated polycarboxylic acid;

(b) dispersing the polyester resin into an aqueous medium to obtain a polyester resin particle dispersion liquid, (c) adding a radical polymerization initiator to the polyester resin particle dispersion liquid to cause a radical polymerization reaction to obtain a radical polymerized polyester resin;

(d) mixing the radical polymerized polyester resin particle dispersion liquid and a coloring agent particle dispersion liquid; and (e) agglutinating the radical polymerized polyester resin particles and the coloring agent particles to form toner particles.

2. The toner manufacturing method as claimed in claim 1, wherein the polyester resin includes an unsaturated polycarboxylic acid.

3. The toner manufacturing method as claimed in claim 2, wherein the unsaturated polycarboxylic acid is a fumaric acid.

4. The toner manufacturing method as claimed in claim 1, wherein the radical polymerization initiator is a water soluble radical polymerization initiator.

5. The toner manufacturing method as claimed in claim 4, wherein the water soluble radical polymerization initiator is potassium persulfate.

6. The toner manufacturing method as claimed in claim 1, wherein a volumetric basis median diameter of each of the radical polymerized polyester resin particles is within a range of 50 to 400 nm.

7. The toner manufacturing method as claimed in claim 1, wherein a volumetric basis median diameter of each of the coloring agent particles is within a range of 10 to 300 nm.

8. The toner manufacturing method as claimed in claim 1, wherein the radical polymerization initiator is added as a polymerization initiator solution in which the radical polymerization initiator is dissolved into an aqueous medium.

* * * * *